United States Patent [19]

King et al.

[11] Patent Number: 4,834,765

[45] Date of Patent: May 30, 1989

[54] TREATMENT OF WOOL MATERIALS

[75] Inventors: Richard D. King, Surrey; Barbara E. Brockway, Berkshire, both of England

[73] Assignee: The University of Reading of Whiteknights House, Reading, England

[21] Appl. No.: 116,298

[22] Filed: Nov. 4, 1987

[30] Foreign Application Priority Data

Nov. 4, 1986 [GB] United Kingdom ..... 8626357

[51] Int. Cl.[4] ..... D06M 13/26

[52] U.S. Cl. ..... 8/128.3; 8/128.1; 8/115.51

[58] Field of Search ..... 8/115.51, 128.1, 128.3

[56] References Cited

PUBLICATIONS

Freedman, et al., "Properties of Protein Disulfide-Isomerase", PHYSIOLOGICAL, TOXICOLOGICAL, AND CLINICAL ASPECTS, edited by A. Larson, et al., Raven Press, New York, 1983, pp. 273-283.

Kaderbhai, et al., "Studies on the Formation of Intrachain Disulfide Bonds in Newly Biosynthesized Bovine Prolactin. Role of Protein-Disulfide Isomerase", EUR. J. BIOCHEM., 1985, 153(1), 167-178.

Grynberg, et al., "Occurrence of a Protein Disulfide Isomerase (EC 5.3.4.1) in Wheat Germ", C.R. HEBD. SEANCES ACAD. SCI., SER. D, 1977, 284(3), 235-238.

Creighton, et al., "Catalysis by Protein-Disulfide Isomerase of the Unfolding and Refolding of Proteins with Disulfide Bonds", J. MOL. BIOL., 1980, 142(1), 43-62.

CHEMICAL ABSTRACTS, vol. 100, No. 13, 3/26/84, p. 264, (Freedman, et al.), "Properties of Protein Disulphide-Isomerase".

CHEMICAL ABSTRACTS, vol. 104, No. 1, (Kaderbhai, et al.), "Studies on the Formation of Intrachain Disulphide in Newly Biosynthesized Bovine Prolactin. Role of Protein Disulphide Isomerase".

CHEMICAL ABSTRACTS, vol. 86, No. 15, (Grynberg, et al.), "Occurrence of a Protein-Disulphide Isomerase in Wheat Germ".

CHEMICAL ABSTRACTS, vol. 94, No. 5, (Creighton, et al.), "Catalysis by Protein-Disulphide Isomerase of the Unfolding and Refolding of Proteins with Disulphide Bonds".

*Primary Examiner*—Paul Lieberman
*Assistant Examiner*—John F. McNally
*Attorney, Agent, or Firm*—Larson & Taylor

[57] ABSTRACT

A process and composition for treating a material comprising wool to ameliorate ageing, mis-shaping and shrinkage employ an enzyme (protein disulphide isomerase) and a cofactor therefor.

8 Claims, No Drawings

TREATMENT OF WOOL MATERIALS

BACKGROUND OF THE INVENTION

The present invention relates to a process for treating wool materials, and to a composition for use in such treatment. It is particularly applicable to the treatment of aged or harshly treated wool textiles to restore at least in part their original properties.

It has long been known that wool consists largely of protein ('keratin'). The physical form of most proteins is strongly affected by the arrangement of disulphide linkages between cysteine residues.

SUMMARY OF THE INVENTION

The present invention arises from the realisation that an aged or ill-treated material comprising wool is likely to have undergone denaturing of the constituent protein, with disruption of the original pattern of disulphide linkages. If this original pattern can be at least partly restored, the material may be 'rejuvenated'.

In one aspect the invention provides a process for treating a material comprising wool in which the material is contacted with a composition which comprises an aqueous medium containing a protein disulphide isomerase, under conditions such that the enzyme can catalyse rearrangement of disulphide linkages in the material. Generally the composition will contain a cofactor for the enzyme.

An isomerase is preferable to (for example) a reductase since the latter requires the presence of a hydrogen donor such as NADPH. However for some purposes other types of enzyme may be useful.

The material comprising wool will generally be a fabric which comprises sufficient wool to affect its properties so that it is amenable to enzymic rejuvenation. The wool may be sheep wool or other animal hair with analogous properties.

Preferably the composition contains substantial amounts of only one enzyme.

In a second aspect the invention provides an enzyme-containing composition for use in such a process. The composition may be usable directly or, more usually, after one or more preliminary steps such as dilution, solution or admixture. A composition may comprise a stable enzyme preparation comprising an enzyme and a carrier (which may be water, generally including a buffer; and/or may be a (preferably soluble) solid).

DESCRIPTION OF THE PREFERRED EMBODIMENTS

A suitable type of enzyme is the protein disulphide isomerase E.C.5.3.4.1, hereafter referred to as PDI. This enzyme is well-characterised and is commercially available from GENZYME (Genzyme Biochemicals Lts., Maidstone, England; Genzyme Corp., Boston, Mass., U.S.A.). It has been described by N.Lambert and R.B.Freedman (1983 Biochem.J. 213 225–234). This type of enzyme seems to occur in every eukaryotic tissue which synthesises a secreted protein. The most easily obtainable tissue type is bovine liver PDI. This may be isolated as follows.

500g of diced bovine liver is washed with physiological saline and extracted at neutral pH with phosphate buffer which contains 1% Triton. This gives an enzyme extract which is then concentrated and purified by procedures involving heat treatment, ammonium sulphate precipitation, ion exchange chromatography, dialysis and finally lyophilization. (See the paper by Lambert and Freedman for fuller details.)

A purer enzyme may be prepared by genetic engineering, i.e. using cloned DNA in a suitable culture.

For use, it is generally necessary to add a very small amount of a low molecular weight thiol as a cofactor. (The concentration need only be of the order of micromolar.)

An example of a suitable thiol which is readily available and is acceptable for treatment of fabrics is dithiothreitol or, more preferably, reduced glutathione.

A suitable composition for use contains 0.01 to 1.0g, preferably 0.03 to 0.3g, of PDI and 1 to 1000, preferably 10 to 1000, micromoles of a cofactor per litre, buffered to a pH in the range of 7 to 8, preferably pH 7.5. A phosphate buffer is preferred. It may also contain other components, e.g. selected from perfumes, and carriers. A wetting agent (to aid penetration of the hydrophobic sheath of a wool fibre) such as a cationic surfactant, is not generally required. Since the thiol is susceptible to aerial oxidation, the storage form of the composition should provide protection from air. The enzyme and cofactor are preferably stored separately as freeze dried powders. The cofactor component thereof, may include the phosphate buffer and any other components, and be stored in an air-free vessel, e.g, a foil sachet, possibly under nitrogen, and/or in an encapsulated form. The enzyme should be protected from harmful materials, e.g. by being packaged analogously to the cofactor. For use, a sachet of cofactor and phosphate buffer is opened and the contents are dissolved in water, preferably at 28° C. Then the enzyme is added.

Fabric is treated at a temperature slightly above room temperature, e.g. 25° to 40° C., preferably 25° to 32° C., most preferably 28° C., for a period of up to 24 hours. The relaxed, now renovated, textile will then be rinsed free of the PDI suspension and the residual enzyme can be removed if necessary - by a 'biological'- washing powder type treatment followed by a final rinse.

The PDI may be modified to improve its stability or effectiveness. Thus it may be dissociated into its subunits, which can show greater activity (presumably since the active sites are then more accessible, particularly to bulky substrates such as keratin, than in the whole enzyme). The enzyme (which term includes a dissociated subunit of natural PDI) may be immobilised on a carrier. A suitable carrier has a large surface area, since an insoluble substrate such as keratin cannot penetrate into the interior. Thus we may use polystyrene beads or other carriers of synthetic polymers (such as polyvinyl resins, nylon, and isocyanate-capped polyurethane foam). This can improve stability and aid storage and use. An enzyme immobilised on a suitable carrier may be recoverable for re-use. An immobilised cofactor is also a possible option. An immobilised component may be recovered by flotation or by adsorption on a suitable material. A support such as polyurethane foam may be constituted as a sponge which can be physically applied to a fabric and easily removed afterwards. The enzyme may be chemically modified to alter its binding properties and Km value.

An example of an embodiment of the invention will now be described.

EXAMPLE

A child's jumper (made of 100% lambswool) was washed harshly at excessive temperature (45°) using a liquid detergent. It was then cut in half. A "control" half was soaked in phosphate buffer at 28° for 4 hours. The "test" half was soaked at 28° for 4 hours in a composition embodying the invention and containing:

PDI (Genzyme) 1g/1
Reduced glutathione (Sigma) 1mM
Phosphate buffer 50mM (to pH 7.5)
Distilled water.

The two halves were dried and compared. The control half was found to be mis-shapen and stretched, whereas the test half had regained its original shape, size and elasticity.

We claim:

1. A process for treating a material comprising wool in which the material is contacted with a composition which comprises an aqueous medium containing a protein disulphide isomerase, under conditions such that the enzyme can catalyse rearrangement of disulphide linkages in the material.

2. A process according to claim 1 in which the protein disulphide isomerase is E.C.5.3.4.1.

3. A process according to claim 1 in which the composition contains 0.01 to 1.0g of protein disulphide isomerase per litre.

4. A process according to claim 1 in which the composition contains a cofactor for the enzyme.

5. A process according to claim 4 in which the cofactor is a thiol.

6. A process according to claim 4 in which the cofactor is reduced glutatione or dithiothreitol.

7. A process according to claim 5 in which there are 10 to 1000 micromoles of cofactor per litre.

8. A process according to claim 1 wherein the compositon is in the temperture range 25 to 32° C.

* * * * *